US012421982B2

(12) United States Patent
Davidenko

(10) Patent No.: US 12,421,982 B2
(45) Date of Patent: Sep. 23, 2025

(54) DIRECT MOUNTING SYSTEM FOR CEILING FANS

(71) Applicant: Delta T, LLC, Lexington, KY (US)

(72) Inventor: Igor Davidenko, Lexington, KY (US)

(73) Assignee: Delta T, LLC, Lexington, KY (US)

( * ) Notice: Subject to any disclaimer, the term of this patent is extended or adjusted under 35 U.S.C. 154(b) by 0 days.

(21) Appl. No.: 18/594,054

(22) Filed: Mar. 4, 2024

(65) Prior Publication Data

US 2024/0209871 A1 Jun. 27, 2024

Related U.S. Application Data

(63) Continuation of application No. 16/907,588, filed on Jun. 22, 2020, now Pat. No. 11,939,992.

(60) Provisional application No. 62/864,559, filed on Jun. 21, 2019.

(51) Int. Cl.
*F04D 29/60* (2006.01)
*F04D 25/08* (2006.01)

(52) U.S. Cl.
CPC ..... *F04D 29/601* (2013.01); *F04D 25/088* (2013.01)

(58) Field of Classification Search
CPC ..... F04D 29/601; F04D 25/088
See application file for complete search history.

(56) References Cited

U.S. PATENT DOCUMENTS 5,542,819 A * 8/1996 Bucher ..... F04D 29/34 416/194
5,937,073 A * 8/1999 Van Gieson ..... H04R 1/026 381/387
6,145,798 A * 11/2000 Janisse ..... F04D 29/601 248/323
6,619,919 B2 * 9/2003 Kerr, Jr. ..... F04D 29/601 24/546
6,991,352 B2 * 1/2006 Garber ..... F21V 21/02 362/147

(Continued)

FOREIGN PATENT DOCUMENTS

WO WO-2016025595 A1 * 2/2016 ..... F04D 25/088

OTHER PUBLICATIONS

DanziX safety stainless steel tether sold on amazon https://www.amazon.com/Stainless-DanziX-Colorful-Lanyards-Diameter/dp/B074C6GLSC Date First Available: Jul. 28, 2017 (Year: 2017).*

(Continued)

*Primary Examiner* — Terrell L McKinnon
*Assistant Examiner* — Ding Y Tan
(74) *Attorney, Agent, or Firm* — Dickinson Wright PLLC; Andrew D. Dorisio; Nicholas P. Coleman

(57) ABSTRACT

A system for mounting a fan to a ceiling includes a connector adapted to attach to the ceiling. The connector includes at least one guide. An adaptor is adapted to attach the fan to the connector, and includes at least one rail adapted for being received within the at least one guide. A safety bracket is also provided, which is adapted to attach to the ceiling separate from the connector and connect to a safety cable without using a tool. A motor support is also provided with a cavity adapted to receive the power supply, and at least one retainer serves to retain the power supply within the cavity. A quick-connecting escutcheon is also adapted to rotatably connect to the connector.

5 Claims, 13 Drawing Sheets

(56) References Cited

U.S. PATENT DOCUMENTS

| | | | | |
|---|---|---|---|---|
| 7,168,670 | B2 * | 1/2007 | Liang | F04D 25/088 403/322.2 |
| 10,955,122 | B1 * | 3/2021 | Skan | F04D 29/646 |
| 11,118,730 | B1 * | 9/2021 | Davidenko | F24F 13/32 |
| 2004/0005218 | A1 * | 1/2004 | Marshall | F04D 25/088 248/317 |
| 2004/0062656 | A1 * | 4/2004 | Marshall | F04D 25/088 416/244 R |
| 2005/0067545 | A1 * | 3/2005 | Coble | F04D 29/601 248/343 |
| 2005/0232776 | A1 * | 10/2005 | Marshall | F24F 7/007 416/210 R |
| 2015/0260199 | A1 * | 9/2015 | Hollan | F04D 25/088 248/342 |
| 2021/0180603 | A1 * | 6/2021 | Oleson | F04D 27/008 |

OTHER PUBLICATIONS

Rite-Hite Revolution 25, 75, 150 series HVLS fans installation manual, publication date: Mar. 7, 2019 https://www.ritehite.com/en/am/products/industrial-fans/hvls-fans/revolution-75-series (Year: 2019).*

* cited by examiner

FIG. 12
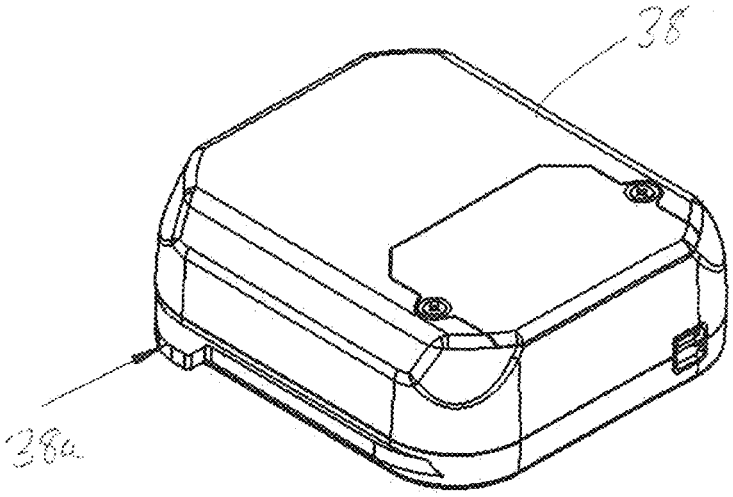
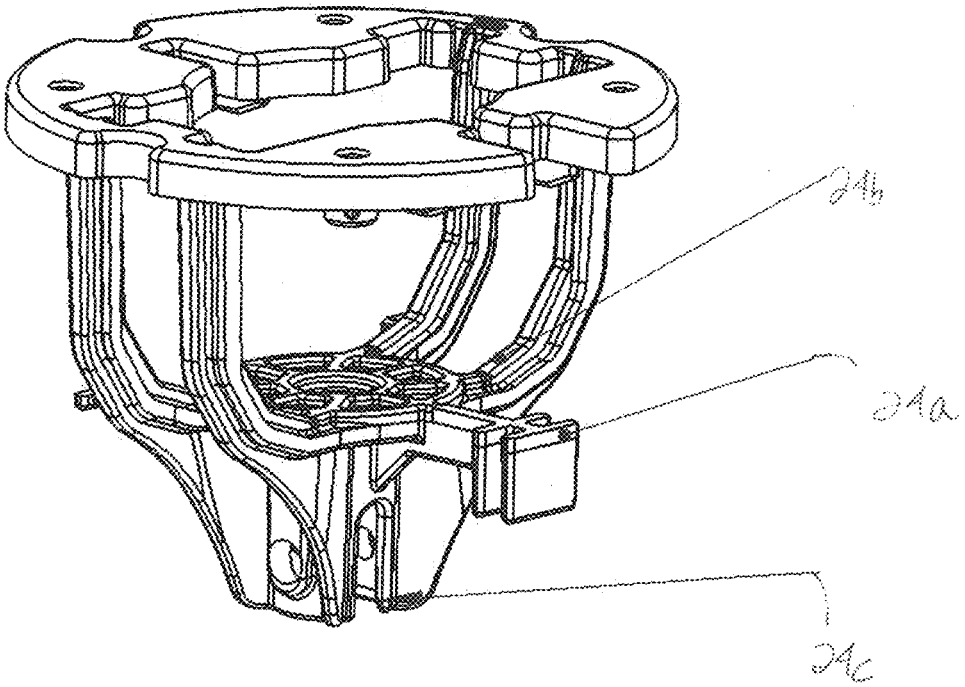
FIG. 13

DIRECT MOUNTING SYSTEM FOR CEILING FANS

This patent application is a continuation of U.S. patent application Ser. No. 16/907,588 filed on Jun. 22, 2020, which claims the benefit of U.S. Provisional Patent Application Ser. No. 62/864,559, filed Jun. 21, 2019, the disclosure of which is incorporated herein by reference.

This disclosure relates generally to a mount for a ceiling fan, and more particularly, to a system for directly mounting a ceiling fan to a ceiling.

BACKGROUND

A variety of fan systems have been made and used over the years in a variety of contexts. In terms of mounting fans specifically, there are a wide range of mounting options available for various ceiling fans. Generally, the mounts are for specific applications that the fans are needed for, ranging from high to low ceilings, flat to heavily sloped ceilings and indoor and outdoor environments. Assembling and mounting ceiling fans, including assembly and arranging of a given power supply, can add time and inconvenience to initial use of a ceiling fan by a user. Furthermore, the use of tools while a user is in a precarious position, along with the stabilization of a ceiling fan prior to installation can create a precarious or dangerous situation for a user. In addition, it has become increasingly popular to mount fans in outdoor environments, in which the fan may be exposed to turbulent air conditions, such as high winds.

Accordingly, there is a need for a robust ceiling fan mounting system for mounting a ceiling fan directly to the ceiling, which is easy to install and use.

Summary

According to one aspect of the disclosure, a system for mounting a fan to a ceiling includes a connector adapted to attach to the ceiling, the connector including at least one guide. An adaptor adapted to attach the fan to the connector. The adaptor includes at least one rail adapted for being received within the at least one guide.

In one embodiment, the at least one guide comprises a channel. The channel may comprise an end wall at a first end, and an opening with a lip at a second end, and wherein the rail is adapted to sit within the channel between the end wall and the lip. The at least one rail may comprise a dampener. A retainer may be adapted to engage both the connector and the adaptor to prevent the fan from swaying. The connector may include a bracket through which the retainer is adapted to pass.

The at least one guide comprises a pair of opposed guides. The at least one rail comprises a pair of opposed rails. Engagement between the pair of opposed rails and the pair of opposed guides prevents lateral movement between the connector and adaptor.

In accordance with a further aspect of the disclosure, a system for mounting a fan to a ceiling is provided. The system comprises a connector adapted to attach to the ceiling and a safety bracket adapted to attach to the ceiling separate from the connector. A safety cable is also provided, a support adapted to connect to a portion of the fan and further adapted to connect to the safety bracket via the safety cable.

In one embodiment, an adaptor for connecting the connector to the support. The safety cable is adapted to connect to the safety bracket without the use of tools. The safety cable is adapted to connect to the safety bracket with a thumb screw. A fastener may be for fastening the safety bracket to the ceiling.

In accordance with a further aspect of the disclosure, a system for mounting a fan to a ceiling is provided. A power supply is provided. A mount including a motor support includes a cavity adapted to receive the power supply. At least one retainer adapted to retain the power supply within the cavity.

In one embodiment, the motor support further comprises a tab adapted to engage the at least one retainer. The power supply includes a stop adapted to prevent movement of the power supply relative to the cavity.

According to a further aspect of the disclosure, a system for mounting a fan to a ceiling is provided. A connector is adapted to attach to the ceiling. An adaptor is adapted to attach the fan to the connector. An escutcheon adapted to releasably connect with and surround the connector.

In one embodiment, the escutcheon is adapted to connect to the connector without using a tool. The escutcheon may be adapted for a rotational connection to the connector. Specifically, the escutcheon may include a plurality of tabs and the connector includes a plurality of receivers. The tabs are adapted to engage the receivers via relative rotation between the escutcheon and the connector, thereby locking the relative positions of the escutcheon and the connector. The system may further include a pin adapted to lock the escutcheon to the connector.

BRIEF DESCRIPTION OF THE DRAWING FIGURES

The above and further advantages of the disclosure may be better understood by referring to the following description in conjunction with the accompanying drawings in which.

Figure 3:
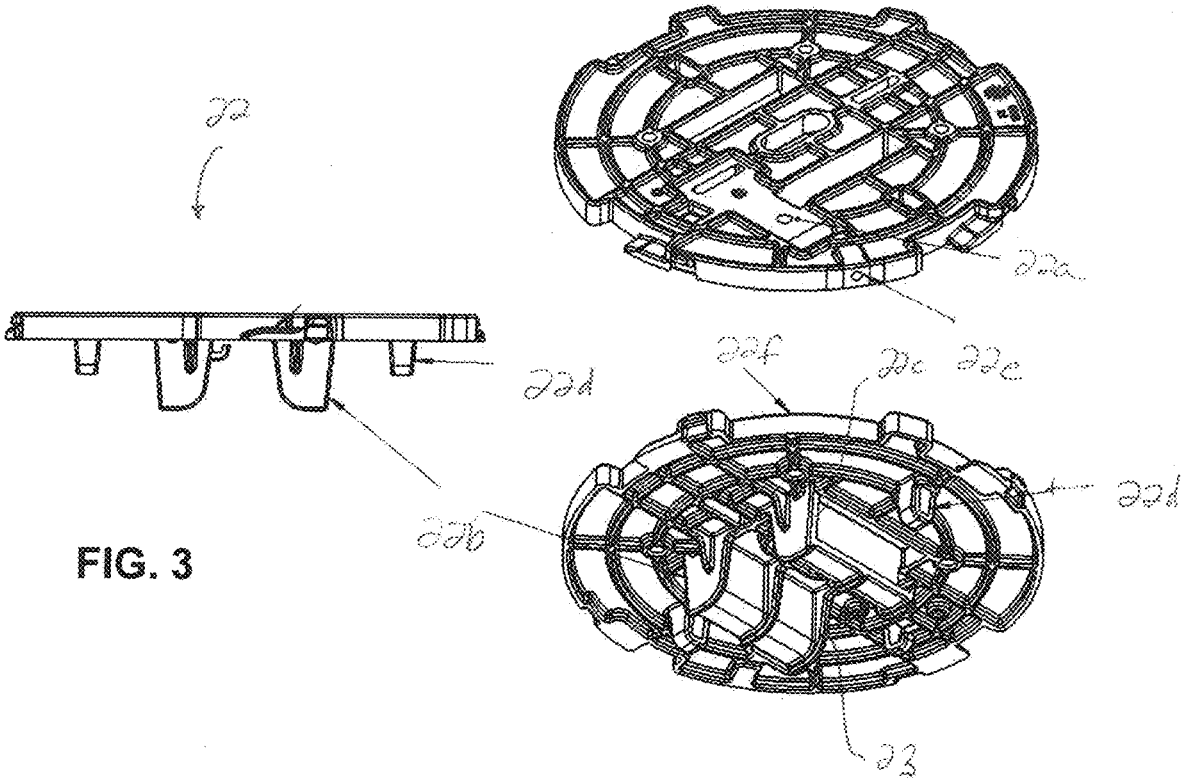

FIG. 3 provides views of a ceiling connector forming one component of the mount.

Figure 4:
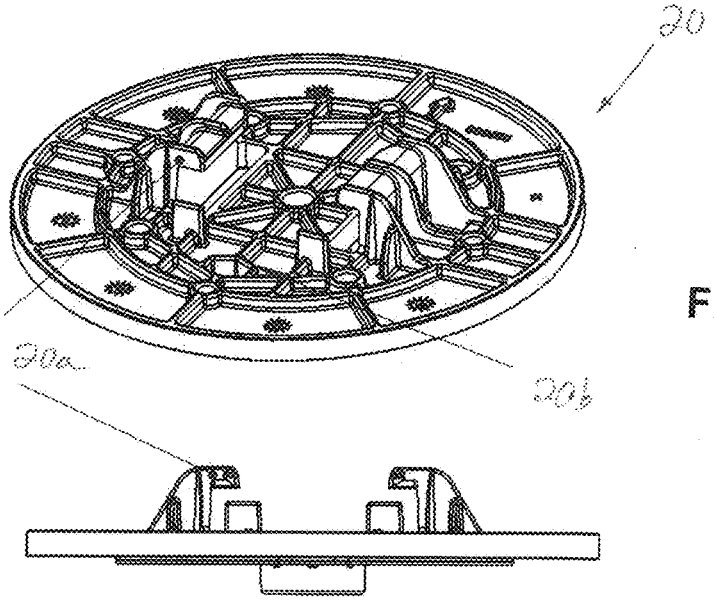

FIG. 4 provides views of an adapter for slidably engaging the ceiling connector in a manner that prevents unintended movement of the associated ceiling fan.

Figure 5:
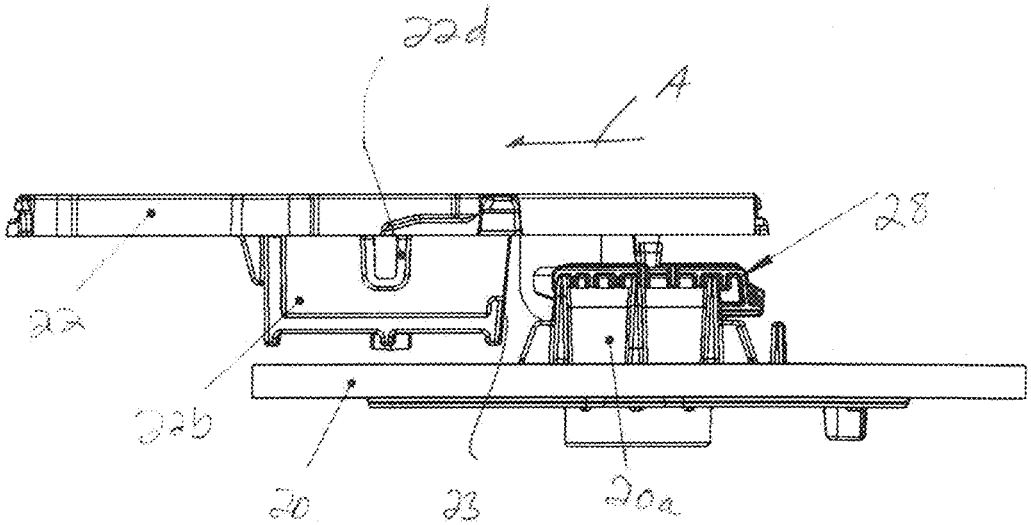
Figure 5A:
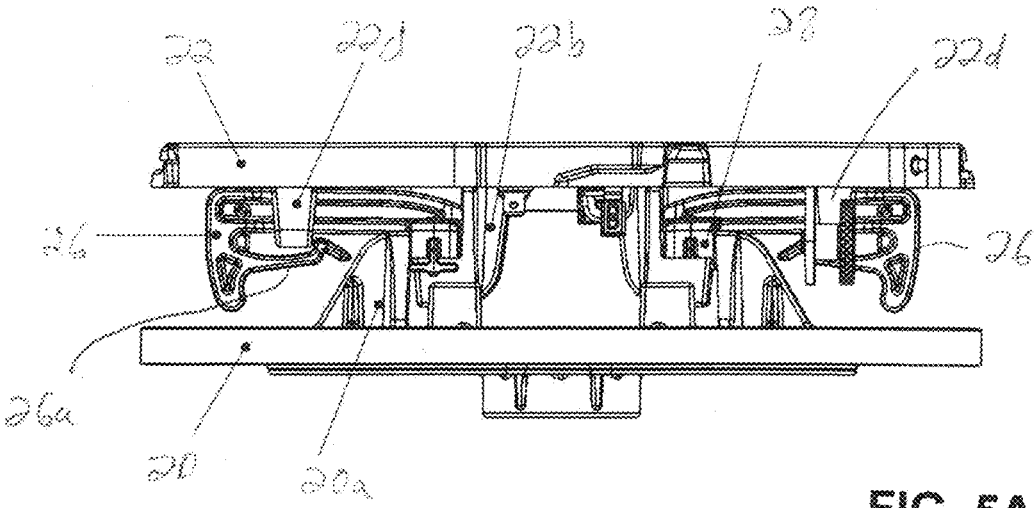

FIGS. 5 and 5A are views of the adapted and connector in partially and fully engaged positions.

Figure 6:
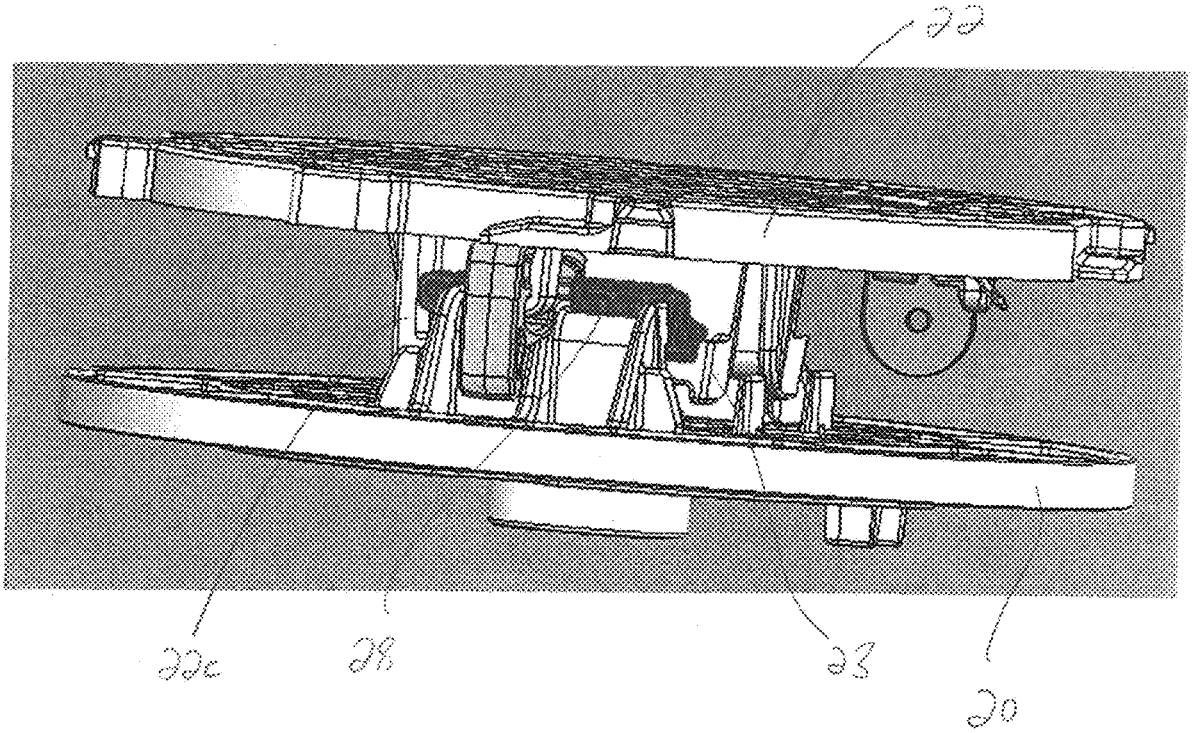
Figure 6A:
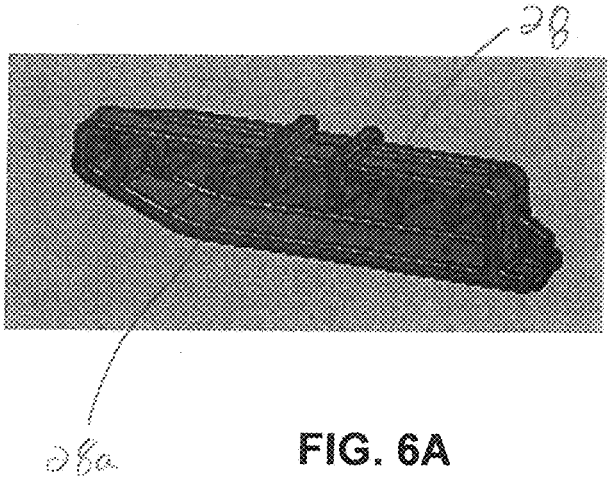

FIGS. 6 and 6A illustrate a dampener for being associated with the mount.

Figure 7:
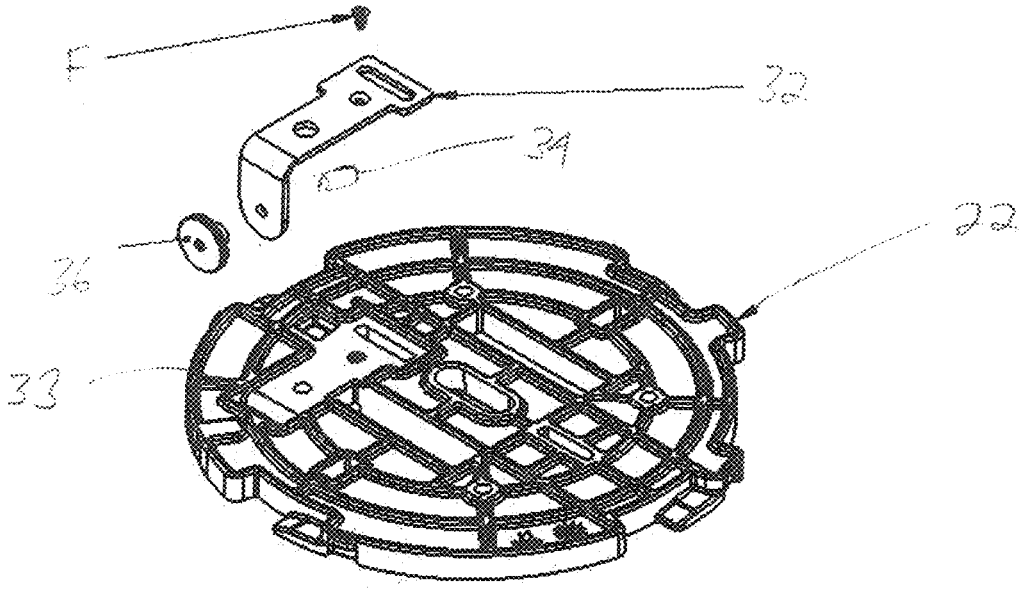

FIG. 7 is an exploded view of a safety cable bracket for use with the connector.

Figure 8:
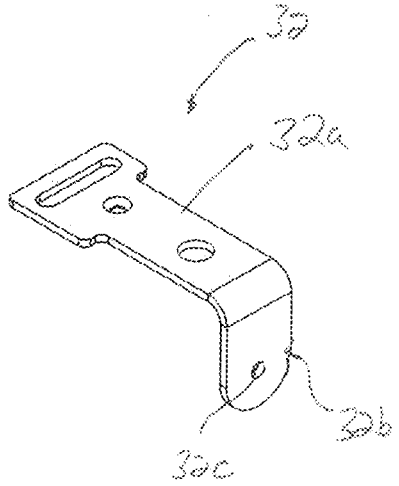

FIG. 8 is a perspective view of the bracket apart from the connector.

Figure 9:
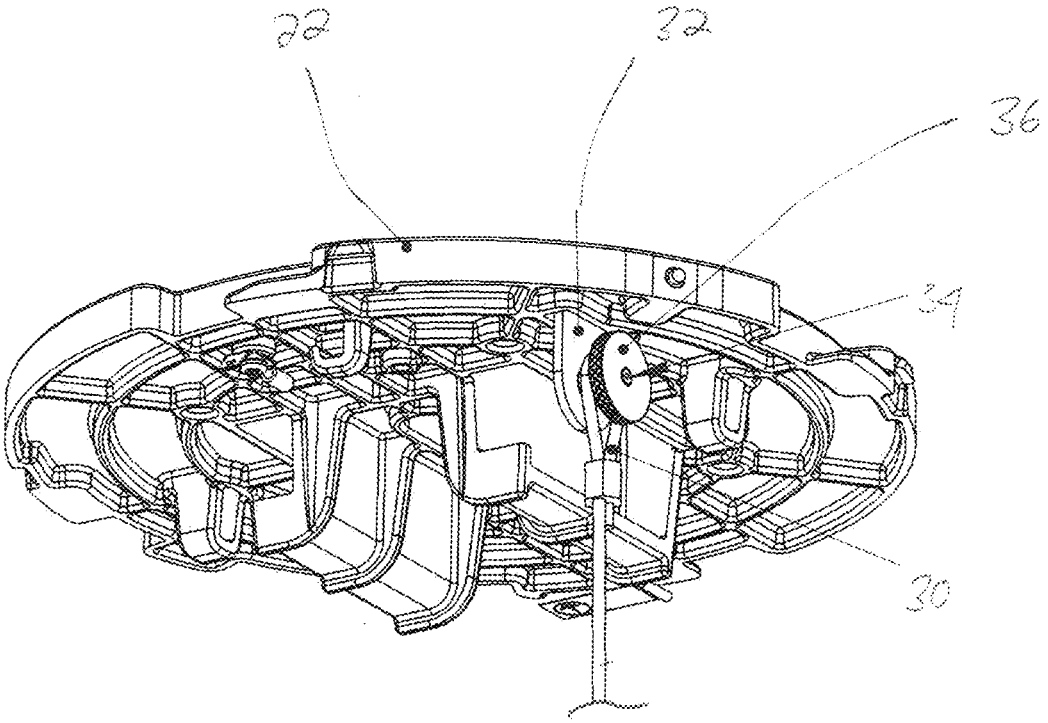

FIG. 9 illustrates the manner in which a safety cable may be connected to the connector via the safety cable bracket, which may independently attach to the ceiling.

Figure 10:
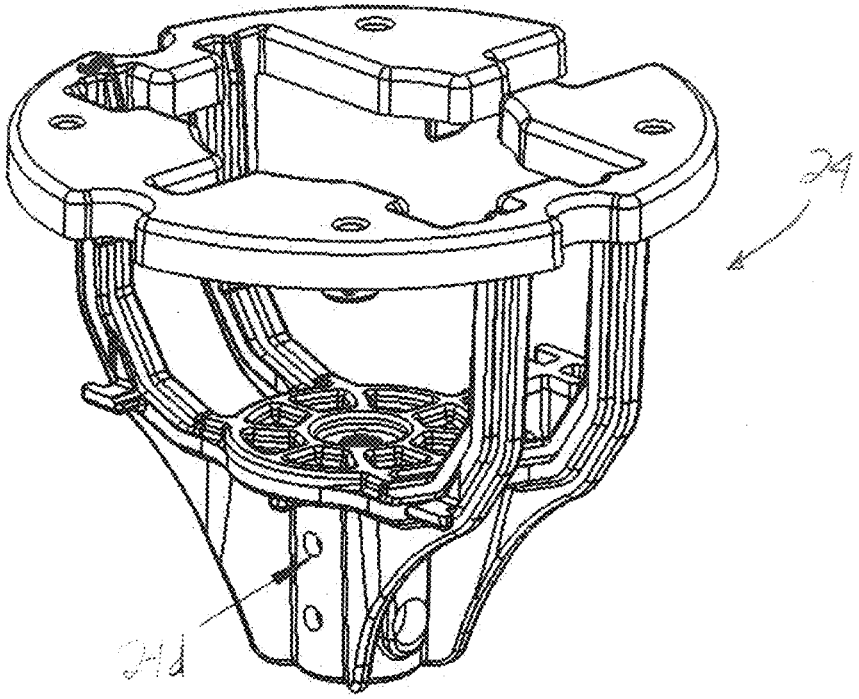
Figure 10A:
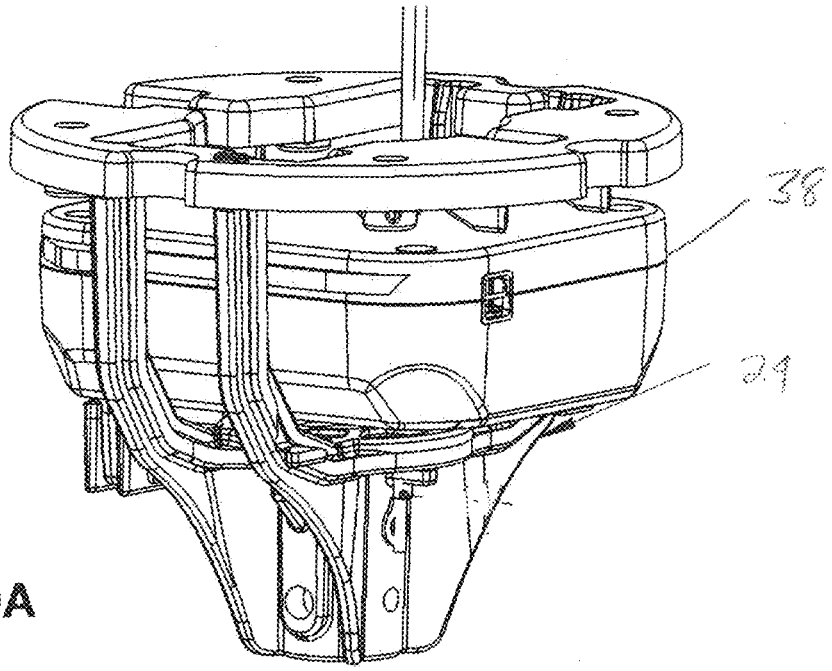

FIGS. 10 and 10A illustrate a motor support and with a cavity for receiving a power supply.

Figure 11:
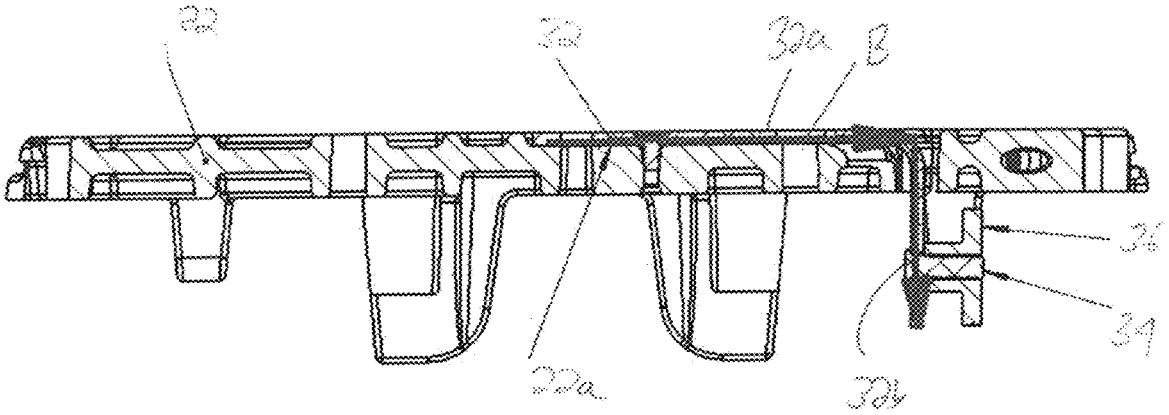
Figure 11A:
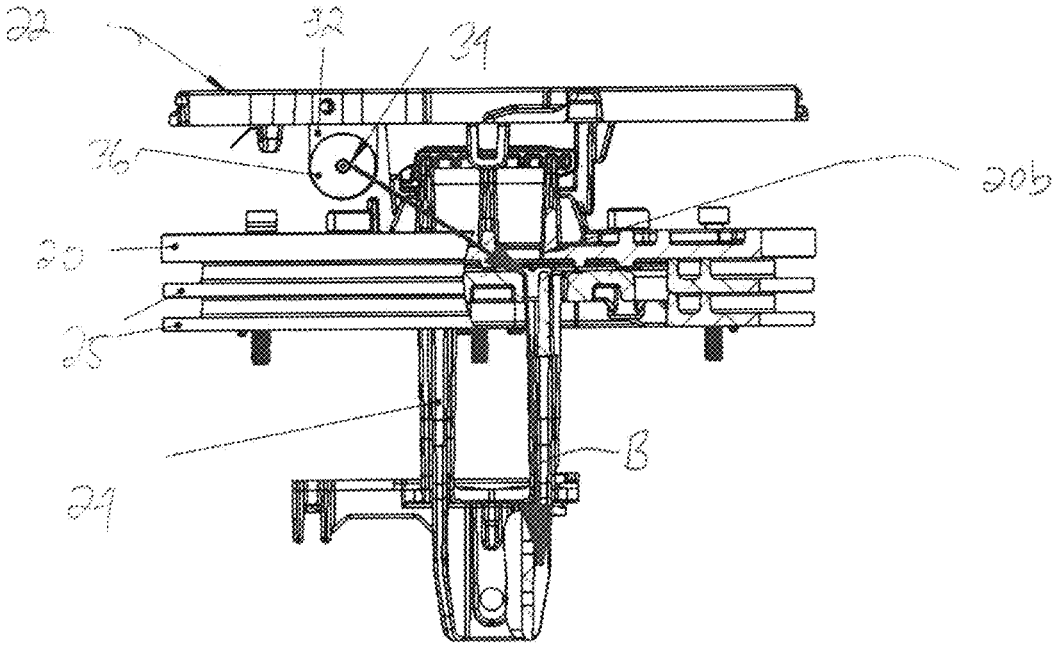

FIGS. 11 and 11A are views of the manner in which a safety cable may be associated with the mount.

Figure 14:
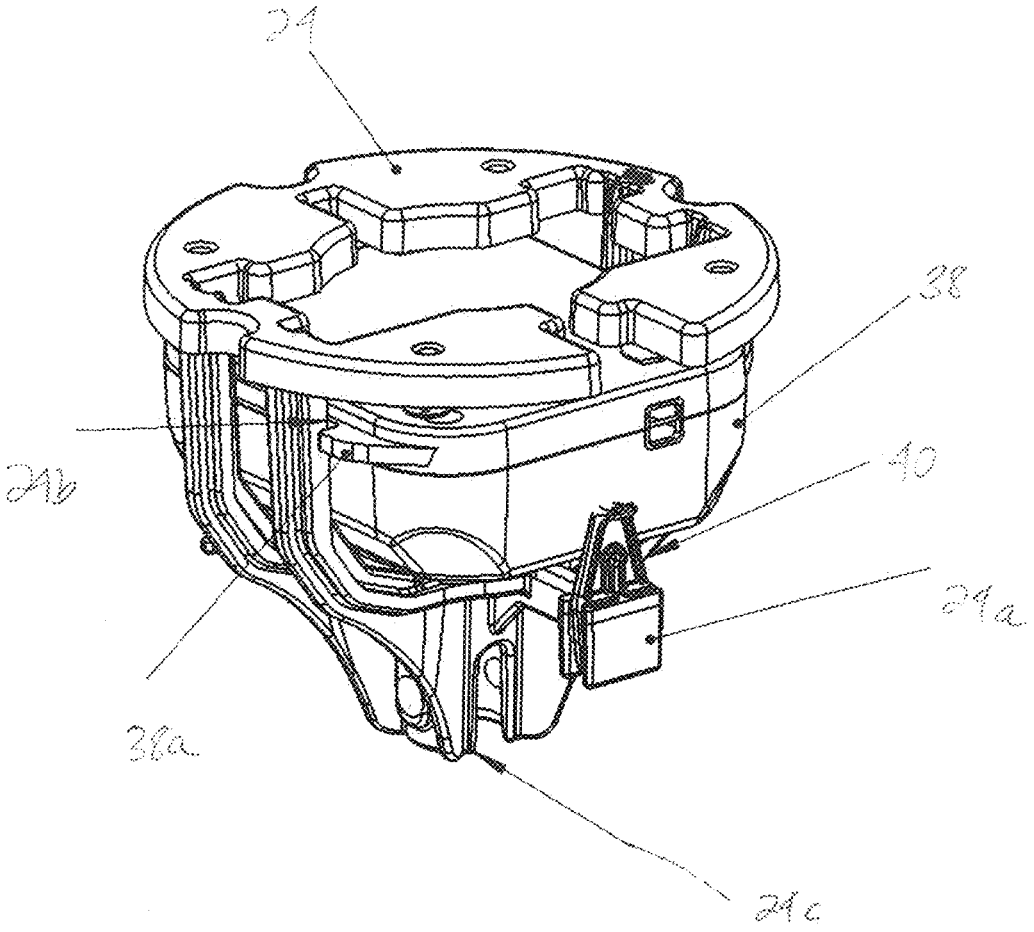

FIGS. 12, 13, and 14 illustrate the power supply and motor support.

Figure 15:
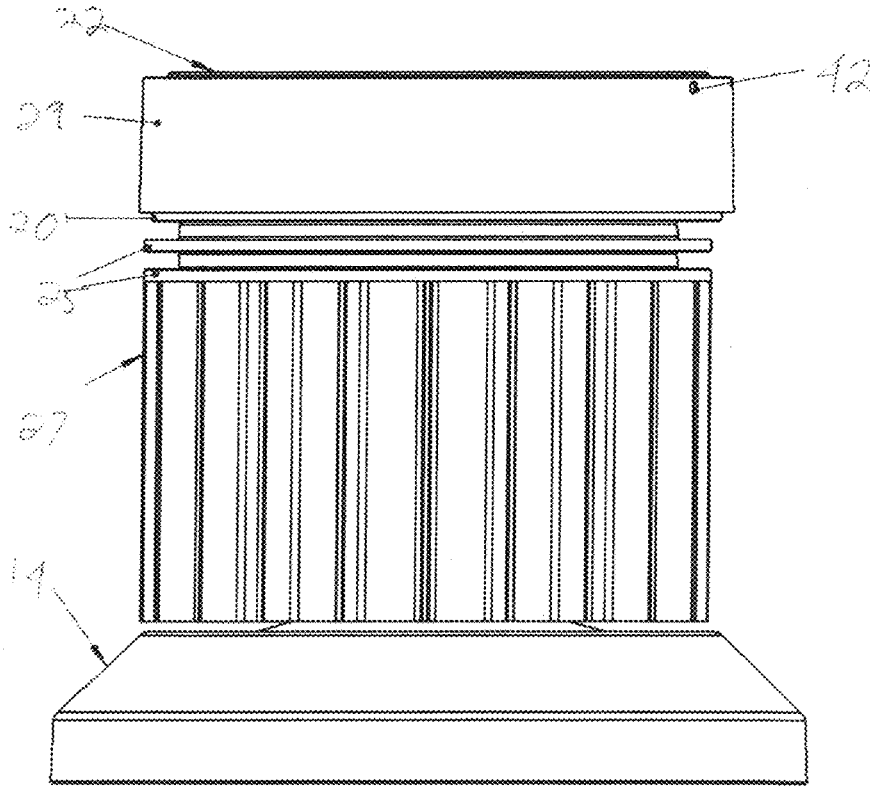
Figure 16:
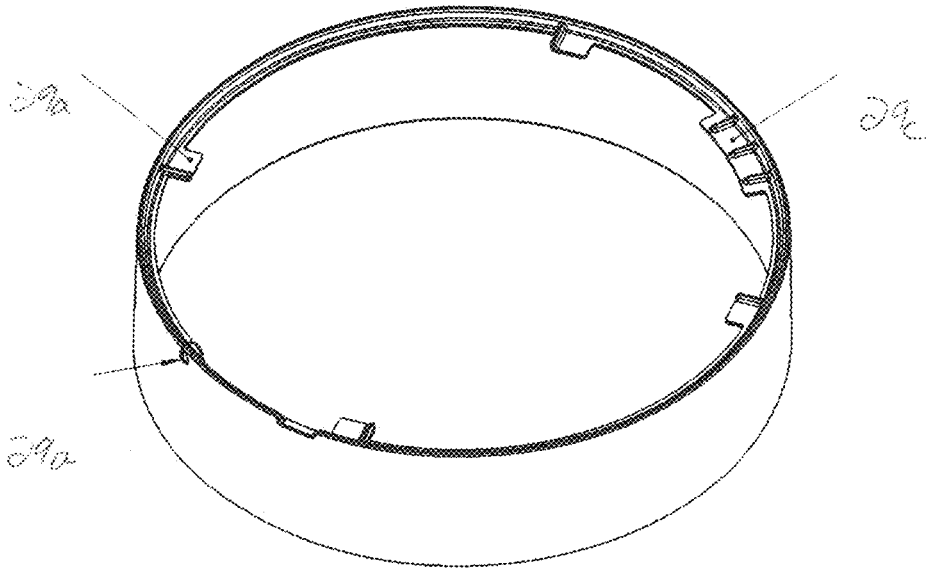
Figure 17:
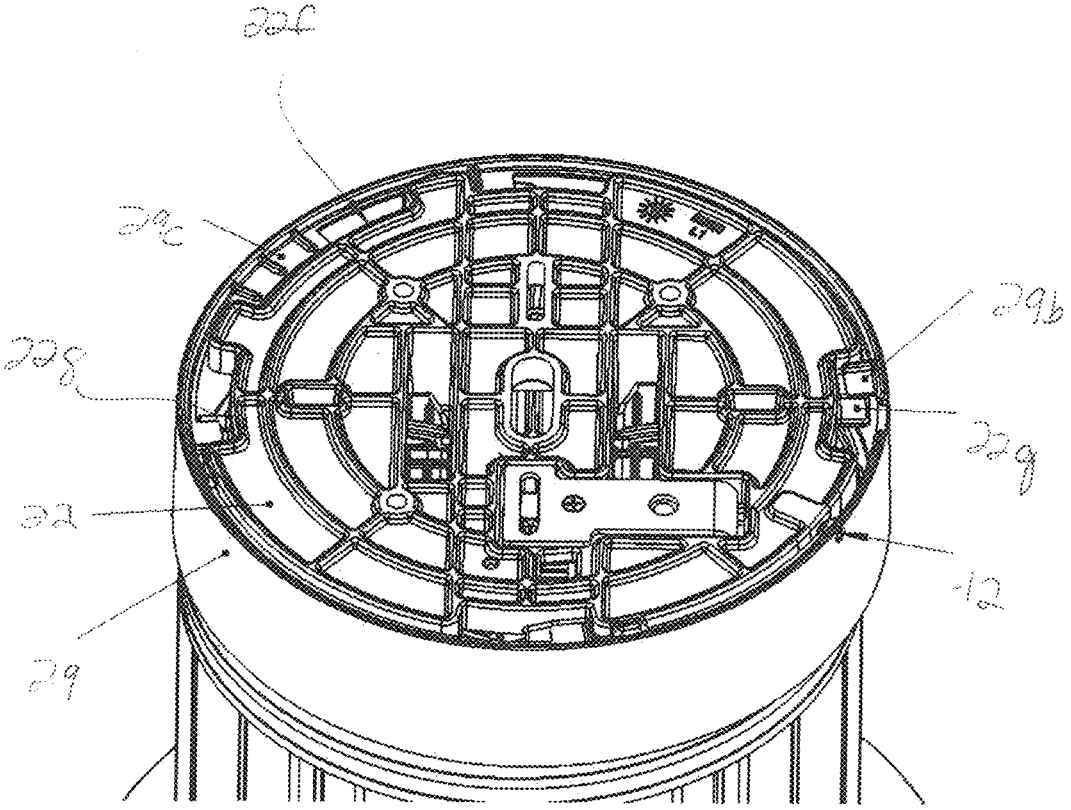

FIGS. 15, 16, and 17 illustrate a quick-connect escutcheon that may form a portion of the mount.

The dimensions of some of the elements may be exaggerated relative to other elements for clarity or several physical components may be included in one functional block or element. Further, sometimes reference numerals may be repeated among the drawings to indicate corresponding or analogous elements. Moreover, some of the items depicted in the drawings may be combined into a single function.

DETAILED DESCRIPTION

The following description of certain examples of the invention should not be used to limit the scope of the disclosure. Other examples, features, aspects, embodiments, and advantages of the invention will become apparent to those skilled in the art from the following description, which includes by way of illustration, one or more of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
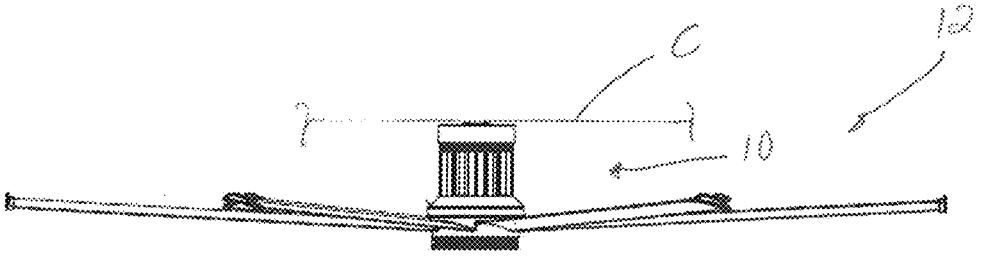
FIG. 1 is a side view of a ceiling fan in a mounted condition.
Figure 1A:
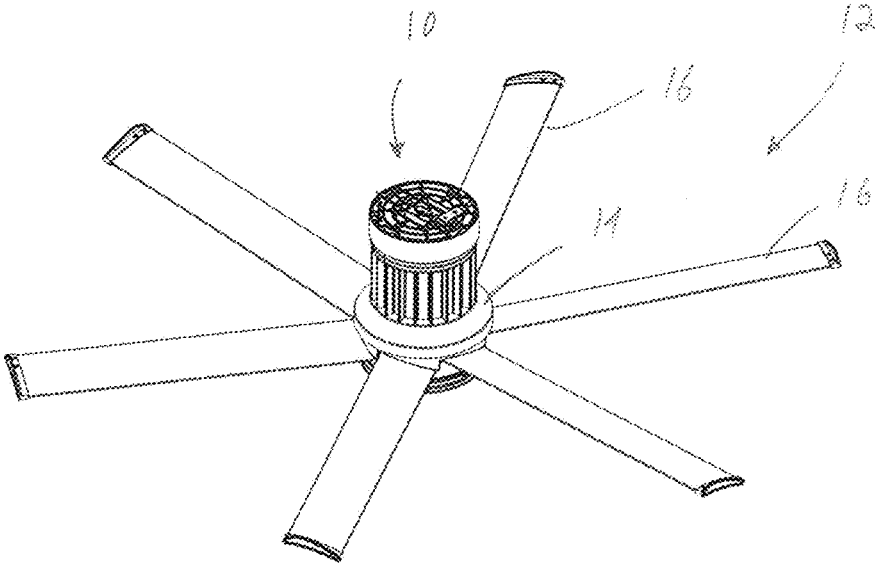
FIG. 1A is a top perspective view of the ceiling fan in an unmounted condition.

With reference to FIGS. 1 and 1A, a mount 10 for a ceiling fan 12 is disclosed. As can be understood from FIG. 1, the ceiling fan 12 may include a hub 14 enclosing a motor M (see FIG. 2). The hub 14 supports a plurality of fan blades 16, and is adapted for rotation as a result of actuator of the motor. The fan 12 may be suspended from a ceiling C, as shown in FIG. 1.

Figure 2:
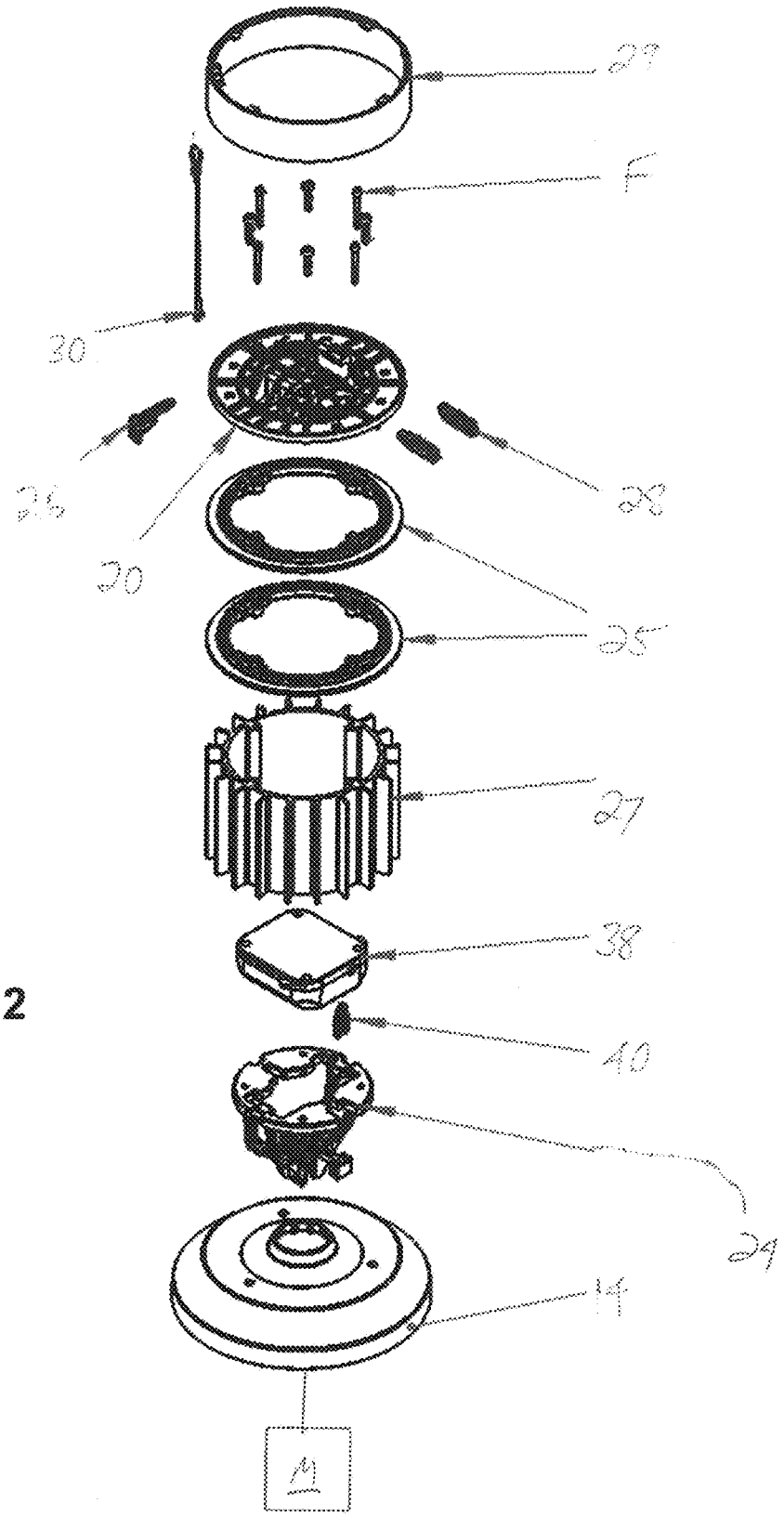
FIG. 2 is an exploded view of a ceiling fan mount according to one aspect of the disclosure.

FIG. 2 is an exploded view showing certain components of the mount 10. Specifically, the mount 10 may include an adaptor 20, which may be in the form of a generally planar or flat plate, adapted for securing the fan to a ceiling connector 22, which may also be in the form of a plate, as described below. A motor support 24 may be connected to the adaptor 20, such as via one or more fasteners F (which may be in the form of screws, bolts, pins, or other fastening devices). The motor support 24 may be adapted to house a power supply 38. One or more spacers in the form of baffle plates 25 may be provided, such as between the adaptor 20 and the motor support 24. A shroud 27 may be provided to shield the motor support 24 from view upon assembly. Similarly, a cover or escutcheon 29 may also be provided for shielding the adaptor 20 and certain components attached thereto from view upon assembly.

In one aspect, and with reference to FIG. 3, the adaptor 20 may be adapted to mate with the ceiling connector 22 to provide an easy mounting system for the fan 12. Specifically, the connector 22 may include one or more guides adapted to slidably receive one or more corresponding rails 20*a* of the adaptor 20. As illustrated, the connector 22 includes two guides, which may comprise elongated channels 22*b*. As illustrated, these channels 22*b* include an open end or entrance for receiving the rail 20*a* and an opposing end wall 22*c* forming a stop for preventing movement of the rail. The open end of the channel 22*b* may further include an interference lip or projection 23 in order to inhibit or hinder removal of the rail 20*a* once it has been placed therein. One side of the channel 22*b* may be open to allow for at least a portion of the rail 20*a* to connect to the adaptor 20 once the rail 20*a* is within the channel 22*b*.

The rails 20*a* are perhaps most easily seen in FIG. 4. As illustrated, the rails 20*a* may comprise elongated projections adapted for mating with the elongated channels 22*b*. The rails 20*a* may include a depending arm adapted to mate with the channels 22*b*. The rails 20*a* may have a generally L-shaped configuration.

In one aspect, the channels 22*b* are opposed, and thus the open sides face in opposite lateral directions, as perhaps best understood from FIG. 3. This prevents lateral movement of the adaptor 20 once the rails 20*a* are within the channels 22*b*. When combined with the end wall 22*c* and lip of the channels 22*b*, the opposite-facing configuration thereof may prevent both lateral movement and longitudinal movement of the rails 20*a* once slid into a mated position. Thus, when the rails 20*a* are within the channels 22*b*, the assembled fan may withstand forces in any direction, such as from wind or other externalities, and prevent or inhibit movement of the fan in the presence of such forces.

With further reference to FIGS. 5 and 5A, installation of the adaptor 20 on the connector 22 is illustrated. FIG. 5 illustrates a side view of the adaptor 20 separated from the connector 22, with the rails 20*a* aligned with the channels 22*b*, prepared for slidable engagement between the two (in the radial direction, as indicated by action arrow A). FIG. 5A illustrates a front view, rotated 90 degrees from the view of FIG. 5, in which the rails 20*a* of the adaptor 20 have engaged the channels 22*b*. Similarly, FIG. 6 illustrates a perspective view of the adaptor 20 engaging the connector 22, in which the rails 20*a* have been placed within the channels 22*b* between the end wall 22*c* and the front lip 23.

Turning back to FIG. 3 and with continued reference to FIGS. 5A and 6, a retainer 26 may be provided for retaining the adaptor 20 in relative position with respect to the connector 22. The retainer 26 may be adapted to prevent a swaying motion of the associated fan, particularly in inclement weather, such as in the presence of wind. For example, the connector 22 may include a bracket 22*d*, and the retainer 26 may engage both the bracket 22*d* and the adaptor 20. The retainer 26 may be inserted through the bracket 22*d* and engage the rail 20*a* of the adaptor 20, thereby retaining the rail 20*a* within the channel 22. The retainer 26 may include a releasable connector, such as a clip 26*a*, adapted to inhibit removing it from the bracket 22*d*.

In a further aspect, one or more dampeners 28 may be provided for placement between the adaptor 20 and the connector 22. As illustrated in FIGS. 5 and 6, the dampener 28 may be positioned on the rail 20*a*, and may be placed within the channel 22*b*. The dampener 28 may provide a surface with a lower coefficient of friction than that of the rail 20*a*, thus allow the rails 20*a* to slide into the channels 22*b* more easily. As shown in FIG. 6A, the dampener 28 may include a receiver 28*a*, such as a gap, a recess, aperture, or a channel, for receiving the retainer 26, thus preventing relative movement between two when fully assembled.

In one aspect, the dampener 28 may comprise a resilient material such as rubber, plastic, foam, or other pliable or elastic or elastomeric material. Accordingly, the presence of the dampener 28 between the rails 20*a* and the channels 22*b* may prevent the fan from rattling when running. Furthermore, in the case of the rails 20*a* and the channels 22*b* being made of metal, the dampener 28 may prevent metal-to-metal contact, which can lead to increased deterioration of the rails 20*a* and/or channels 22*b*. Additionally, the resilient nature of the dampeners may allow the fan to hang at a slight angle on ceilings that are not completely flat.

With further reference to FIGS. 7, 8, 9, 10, 11, and 11A, an improved safety cable anchoring system is disclosed. Current safety cables are attached to the mount via a threaded fastener, such as screw, which may require a tool or some mechanism that wraps around the mount. Such a configuration may be cumbersome and or confusing, this also often causes the end user to not properly anchor the safety cable to the mount.

As with other cable anchoring systems, a safety cable 30 may be provided for preventing the fan from falling to the ground, thereby possibly causing damage. The safety cable 30 may comprise a wire, chain, or other fastening device, which may be made of metal, plastic, or other sturdy material adapted to hold the weight of the fan in the event that the normal fan mounting (e.g. the guide/rail system described herein) fails.

With reference to FIG. 10A, the motor support 24 may include a safety cable mount 24*d*, such as an aperture, post, clip, or other fastener receiver. The safety cable 30 may be attached to the motor support 24 at the safety cable mount 24*d* via a fastener such as a screw, bolt, pin, or other fastening device. The safety cable 30 may extend up from the safety cable mount 24*d*, around or through the motor support 24, and through a cable aperture 20*b* in the adaptor 20 in order to connect with the ceiling connector 22.

The ceiling connector 22 may include a safety bracket 32, or may be adapted to connect to a safety bracket 32, in order to transfer weight through the safety cable 30 to the safety bracket 32. The safety bracket 32 may be adapted to connect directly to a ceiling or other mounting surface in order to transfer weight from the fan directly to the ceiling or other mounting surface from the safety cable 30 and through the safety bracket 32. In one aspect, the safety bracket 32 may be connected directly to the ceiling, such as via a separate fastener F, so that any weight from the fan, in the event of failure of the normal mounting mechanism, is not passed solely to the ceiling plate, but rather is transferred directly to the ceiling. The safety bracket 32 may be made of a sturdy material, such as stainless steel, and may be of a thickness and grade adapted to bear the weight of the ceiling fan.

As shown in FIG. 8, the safety bracket 32 may be an L-shaped bracket with a first leg 32*a* and a second leg 32*b*. The first leg 32*a* may be adapted to be positioned parallel to the ceiling and to connect to the ceiling via the separate bolt. The second leg 32*b* may be adapted to extend downward for connection to the safety cable 30.

With reference to FIGS. 3 and 7, the ceiling connector 22 may include a safety bracket receiver 33, such as a recess or cavity in the connector, for receiving the safety bracket 32. As illustrated, the safety bracket receiver 33 includes a recess extending transversely or radially for a receiving the first leg 32*a* of the safety bracket, and an aperture through which the second leg 32*b* of the safety bracket may pass downwardly in the axial direction.

Referring to FIG. 9, the safety cable 30 may be adapted to connect to the safety bracket 32 in order to secure the safety cable anchoring system. For ease of installation, in one aspect the safety cable 30 may be adapted to connect to the safety bracket 32 without the need for external tools, such as screwdrivers, wrenches, including wrenches, pliers, hammers, or the like. For example, a rod 34, such as a steel stud, pin, or peg, may be inserted into an opening 32*c* of the safety bracket 32. The opening 32*c* may be threaded and adapted to receive the rod 34 via a threaded connection. In one aspect, a fastener 36, such as a nut, knob, clip, hook, clasp, or other fixing device, may be used to secure the safety cable 30 on the rod 34, which together may be considered to form a thumb screw. Thus, no external tools are needed to secure the motor support 24 to the safety bracket 32 via the safety cable 30.

Turning to FIGS. 11 and 11A, the load path of the transfer of weight of the fan through the safety cable 30 is illustrated. As can be seen by the arrows B, the load may be transferred along the first leg 32*a* of the safety bracket 32, which is directly connected to the ceiling, such as via the separate bolt. The weight may be transferred through the second leg 32*b* and into the safety cable 30 attached thereto. The safety cable 30 may then bear the weight of the fan through the safety cable, and down to the safety cable mount 24*d* of the motor support 24.

In a further aspect, the fan may include a novel power supply mount, as illustrated in FIGS. 12-14. In normal fan installation, the end user or other person responsible for fan installation must also install a power supply 38. This may add to time and complexity of installation. As shown in FIG. 13, the motor support 24 may include a power supply cavity 24*b* adapted to receive the power supply 38 therein. This may save space and provide support and security for the power supply 38. The power supply cavity 24*b* may be defined by one or more supports, such as walls, columns, posts, or brackets, which connect a lower end of the power supply cavity 24*b* to an upper end of the power supply cavity 24*b*. As shown in FIG. 13, the power supply cavity 24*b* may be located above a connector 24*c* of the motor support 24 for connecting with a portion of a motor, such as an upwardly directed motor shaft.

The power supply 38 may be adapted to slide into the power supply cavity 24*b*. A stop 38*a*, such as a tab or other projection, may be provided in association with the power supply 38. The stop 38*a* may be adapted to engage the motor mount 10 in order to restrict motion of the power supply 38 within the power supply cavity 24*b*. For example, the stop 38*a* may engage one or more of the supports forming the power supply cavity 24*b*.

The motor support 24 may further include a tab 24*a* or other projection, which may be adapted to engage a removable lock 40 in order to secure the power supply 38 within the power supply cavity 38*b*. The tab 24*a* may be adapted to extend to an end of the power supply 38 when the power supply 38 is fully within the power supply cavity 24*b* (i.e. when the stop 38*a* prevents further movement of the power supply 38 into the power supply cavity 24*b*). The lock 40 may be adapted to engage an end of the tab 24*a* and make contact the power supply 38, thus preventing removal of the power supply 38 from the power supply cavity 24*b*, as shown in FIG. 14. This assembly and securing of the power supply 38 within the motor support 24 10 may be done prior to providing the fan to the user, such as at a factory during fan assembly.

In a further aspect, as illustrated in FIGS. 15-17, the fan may include an escutcheon 29 adapted to surround at least some mounting components, thus shielding the components from view upon assembly. For example, the escutcheon 29 may surround the ceiling connector 22 and the adaptor 20, thus at least partially or totally shielding these structures from view upon assembly. In one aspect, the escutcheon 29 may fully conceal all elements between the ceiling connector 22 and the adaptor 20 from view.

While the fan is being installed, the escutcheon 29 may be placed over the fan mounting elements. The escutcheon 29 may be large enough in diameter that it can easily slip over the adaptor 20, the baffle plates 25 and the shroud 27, and rest on the motor hub 14 during installation. After connection of the adaptor 20 to the ceiling connector 22, the escutcheon 29 may be slid upwardly into place.

The normal process for installing an escutcheon is to attach it via multiple fasteners, such as screws, which may require a tool for attachment. This may be cumbersome for the user, as installations of ceiling fans are typically accomplished in precarious positions, such as on top of a ladder. Not only can the use of a tool for installation be awkward or even dangerous, but it is often possible to drop fasteners, which may at the very least cause frustration for the installer.

The escutcheon 29 as disclosed herein may be adapted for installation without any tools. For example, the escutcheon 29 may include at least one alignment tab 29*c*, adapted to align with an alignment receiver 22*f* on the ceiling connector 22. The alignment tab 29*c* and the alignment receiver 22*f* may be positioned along a perimeter of the escutcheon 29 and connector 22, respectively. Alignment of the alignment tab 29*c* with the alignment receiver 22*f* may position the escutcheon 29 for installation.

In one aspect, the escutcheon 29 may include one or more radial projections, such as in the form of a sloped tab 29*b*, which may be adapted to engage one or more receivers on the ceiling connector 22. The receivers may be in the form of a ramped tabs 22*g* included in or on the ceiling connector 22. As illustrated, the escutcheon locking tabs 29*b* are located along an upper perimeter of the escutcheon 29, such that the escutcheon 29 may be rotated so that the tabs 29*b* may engage the receivers (tabs 22*g*) and releasably retain the escutcheon on the ceiling connector 22, thus allowing for quick and easy installation of the escutcheon 29 without using a tool.

A spring pin 42 or other locking mechanism (e.g. detent) may be associated with a spring pin cavity 22*e* on the ceiling connector 22, and may engage an aperture 29*a* in the escutcheon 29, thereby locking the escutcheon 29 in place with respect to the ceiling connector 22. The escutcheon 29 may be removed by depression of the spring pin 42 and rotating the escutcheon with respect to the ceiling connector 22 for removal.

As used herein, the following terms have the following meanings:

"A", "an", and "the" as used herein refers to both singular and plural referents unless the context clearly dictates otherwise. By way of example, "a compartment" refers to one or more than one compartment.

"About," "substantially," or "approximately," as used herein referring to a measurable value, such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Although the invention has been described in conjunction with specific embodiments, many alternatives, modifications, and variations will be apparent to those skilled in the art. Accordingly, it embraces all such alternatives, modifications, and variations that fall within the appended claims' spirit and scope. All publications, patents and patent applications mentioned in this specification are herein incorporated in their entirety by reference into the specification, to the same extent as if each individual publication, patent or patent application was specifically and individually indicated to be incorporated herein by reference. In addition, or identification of any reference in this application shall not be construed as an admission that such reference is available as prior art to the present disclosure.

The invention claimed is:

1. A system for mounting a fan to a ceiling, comprising:
- a connector attached directly to the ceiling;
- a safety bracket attached directly to the ceiling via a separate fastener fastened to the ceiling, separate from the connector;
- a safety cable; and
- a support adapted to connect to a portion of the fan and further adapted to connect to the safety bracket via the safety cable;
- wherein the connector includes a receiver on a top of the connector, the receiver adapted to receive at least a portion of the safety bracket on the top of the connector;
- wherein the connector includes an aperture therethrough, and wherein at least a portion of the safety bracket passes through the aperture to connect with the safety cable on a bottom of the connector.

2. The mounting system of claim 1, further including an adaptor for connecting the connector to the support.

3. The mounting system of claim 1, wherein the safety cable is adapted to connect to the safety bracket without the use of tools.

4. The mounting system of claim 1, wherein the safety cable is adapted to connect to the safety bracket with a thumb screw.

5. The mounting system of claim 1, wherein the separate fastener attaching the safety bracket to the ceiling is adapted to transfer weight from the fan directly to the ceiling.

* * * * *